US005701681A

United States Patent [19]

Wonka et al.

[11] Patent Number: 5,701,681

[45] Date of Patent: Dec. 30, 1997

[54] HAND-HELD HAIR DRYER

[75] Inventors: Boris Wonka, Neu-Isenburg; Jürgen Behrendt, Idstein; Gerald Imhof, Griesheim, all of Germany

[73] Assignee: Braun Aktiengesellschaft, Kronberg, Germany

[21] Appl. No.: 786,510

[22] Filed: Jan. 21, 1997

[30] Foreign Application Priority Data

May 23, 1995 [DE] Germany ..... 195 18 812.8

[51] Int. Cl.[6] ..... A45D 00/00

[52] U.S. Cl. ..... 34/97; 34/96

[58] Field of Search ..... 34/96, 97

[56] References Cited

U.S. PATENT DOCUMENTS

| | | | |
|---|---|---|---|
| 2,420,732 | 5/1947 | Bichsel, et al. | 34/243 |
| 2,678,376 | 5/1954 | Lockwood | 219/39 |
| 3,518,776 | 7/1970 | Wolff et al. | 34/97 |
| 4,197,448 | 4/1980 | Harigai | 219/370 |
| 4,903,416 | 2/1990 | Levin et al. | 34/97 |

FOREIGN PATENT DOCUMENTS

| | | | |
|---|---|---|---|
| 0 068 491 | 1/1983 | European Pat. Off. | A45D 20/12 |
| 0 413 959 A2 | 2/1991 | European Pat. Off. | A45D 20/12 |
| 0 463 315 A2 | 1/1992 | European Pat. Off. | A45D 20/10 |
| 2 508 289 | 12/1982 | France | A45D 20/10 |
| 29 20 400 | 11/1980 | Germany | A45D 20/12 |
| 9000337 U | 4/1990 | Germany | A45D 20/10 |
| 9001199 U | 7/1990 | Germany | A45D 20/10 |
| 39 03 231 A1 | 8/1990 | Germany | A45D 20/10 |
| 39 06 265 A1 | 8/1990 | Germany | A45D 20/10 |
| 8910115 U | 2/1991 | Germany | A45D 20/10 |
| 41 00 398 A1 | 7/1992 | Germany | A45D 20/12 |
| 295 00 758.3 | 6/1995 | Germany | A45D 20/08 |
| 2 227 655 | 8/1990 | United Kingdom | A45D 20/10 |

*Primary Examiner*—Henry A. Bennett
*Assistant Examiner*—D. Doster
*Attorney, Agent, or Firm*—Edward S. Podszus

[57] ABSTRACT

The invention is directed to a hand-held hair dryer including a housing (10) which is comprised of a handle (12) and an air-moving outer tube (14); the outer tube (14) possesses an inlet port (16) and an outlet port (18) for an air stream, and the housing accommodates a heater and a fan generating and heating the air stream. Arranged in the outer tube (14) is an inner tube (42) receiving at least the heater. In this arrangement, the inner tube (42) is manufactured from a material having a higher thermal stability than the outer tube, and the inner tube (42) terminates flush with at least the outlet port of the outer tube (14) or projects beyond the outlet port of the outer tube (14) in the direction of flow (64). A hair styling implement as, for example, a nozzle (44), a diffuser or the like, is attachable to the inner tube (42).

24 Claims, 4 Drawing Sheets

HAND-HELD HAIR DRYER

This application is a continuation of International Application No. PCT/EP96/01944.

This invention relates to a hand-held hair dryer including a housing which is comprised of a handle and an air-moving outer tube. The outer tube possesses an inlet port and an outlet port for an air stream, and the housing accommodates means as, for example, a motor with a fan impeller and a heating unit, for generating and heating the air stream. Arranged in the outer tube is an inner tube receiving at least the means for heating the air stream, and the inner tube is manufactured from a material having a higher thermal stability than the outer tube.

The present invention is based on a hair dryer of the type disclosed in EP 0 463 315 A2, which includes a double-walled housing through which a secondary air stream can be directed. This hair dryer has a central supporting member to which all the other housing parts of the hair dryer are secured directly or indirectly, and it is provided with a handle adapted to rotate about an axis of rotation approximately normal to a housing longitudinal axis, the handle performing individual angular steps as it rotates.

Further, appliances are known in the art, such as the HL 2000 hair dryer distributed by the applicant, in which a tubular supporting member is provided in the housing. This supporting member, which is configured as an inner tube, is manufactured from a material of a thermal stability higher than that of the outer tube. As a result, it has been possible to use different qualities of plastic material for the manufacture of the housing and the inner tube. The outlet port of this housing is formed by the outer tube which receives at the same time a protective screen, so that the outer tube contacts the exiting hot air, making it necessary for it to be fabricated from a material, for example, a plastic material, having a minimum thermal stability. In cases where it is possible to use an additional hair styling implement as, for example, a nozzle, a diffuser or the like, with the hair dryer, this implement is attached to the outlet port of the outer tube.

It is an object of the present invention to provide an improved, novel, and user-friendlier hair dryer which affords greater economy of manufacture.

This object is accomplished by the present invention in that in a hand-held hair dryer of the type initially referred to the inner tube located in the housing terminates flush with at least the outlet port of the outer tube or projects beyond the outlet port of the outer tube in the direction of flow, and that a hair styling implement as, for example, a nozzle, a diffuser or a similar implement, is attachable to the inner tube. By arranging the heating unit for heating the air stream in this inner tube, it is accomplished that the hot air stream is prevented from impinging upon any location on the outer tube, and that the outer tube, the handle and further housing components are exposed to lower temperatures. Considering that these components represent a major part of the housing, this provides the advantage of enabling significant material savings to be realized. By arranging the inner tube so it terminates flush with the outlet port of the outer tube or projects beyond the outlet port of the outer tube, it is ensured that the outer tube is thermally decoupled from the hot air stream. Further, a direct connection between the components exposed to the hot air stream is accomplished, that is, between the inner tube and the hair styling implement. This enables the use of a plastic material of lower thermal stability, for example, polypropylene (PP) for the manufacture of the outer tube, whilst only the inner tube requires a plastic material of higher thermal stability, for example, polyamide (PA) or polybutylene terephthalate (PBT). Advantageously, the use of a dyeable plastic material is also possible for the inner tube in which the heating unit is received. This enables the user to see that the inner tube is made from a material different from that of the housing outer tube surrounding it.

Another advantage is that an outlet screen is provided directly on the inner tube, and that this screen may be mounted on the inner tube in a prior operation. The use of a plastic material with a higher thermal stability for the inner tube thus also results in a higher durability of the connection of the outlet screen in the inner tube than would be the case if the outlet screen were mounted in an outer tube made of a plastic material of lower thermal stability or strength.

In a further embodiment, it is proposed arranging the outlet screen directly in the area of the outlet port of the inner tube. The advantage of this arrangement is that it ensures safe operation of the hair dryer without involving the risk for a user to reach into the hot inner area of the housing, for example.

Still further, it is proposed securing the outlet screen to the inner tube by positive engagement therewith, so that the screen is securely held in the inner tube, and that ease of assembly of the screen within the inner tube is made possible advantageously.

By providing for the inner tube to engage the outer tube in the area of the outer tube's outlet port, the inner tube is advantageously located on the outer tube with a minimum surface area of relative engagement. Preferably, the inner tube and the outer tube are concentrically arranged.

In a further embodiment of the present invention, it is proposed that the outside diameter of the inner tube correspond at least in some areas approximately to the inside diameter of the outer tube. This enables a concentric arrangement of the inner tube in the outer tube. Moreover, the outside diameters of the two tubes are nearly identical because the outer tube is larger than the inner tube merely by the amount of the wall thickness. This avoids advantageously a marked difference in the diameters of the inner tube and the outer tube while enabling a maximum possible area oft cross-section of the inner tube through which air is allowed to flow.

In a further aspect of the present invention, the fasteners providing for releasable attachment of the hair styling implement are provided on the inner tube. By providing for such direct attachment of the implement to the inner tube, forces produced by the mounting of a hair styling implement are prevented from acting on the outer tube, thus making it possible for the outer tube to be advantageously manufactured from a material of less strength than the inner tube.

Advantageously, the inner tube is provided with latches which serve the function of attaching the hair styling appliance as by means of a bayonet-type connector, a clip lock mechanism or the like. These latches afford the advantage of enabling rapid, easy and secure attachment of the implement to the hair dryer by its user.

In an advantageous further aspect of the present invention which may also be an independent invention, a channel, for example, a cable duct, is provided on the outside of the housing essentially parallel to the main axis of the housing. This channel receives, for example, the motor cables connecting the fan motor with the electric operating controls disposed in the handle. Owing to this increase in the housing's cross-section by the provision of the channel and the reception of the cables in this channel, the maximum possible free cross-section of the housing is advantageously maintained. On the other hand, this accordingly enables the outer tube of the housing to be of a smallest possible diameter. The provision of the hitherto required annular free space between the inner tube and the outer tube for reception of the cables is thus obviated by the arrangement herein proposed, the outer tube may be reduced in size while the cross-section of the inner tube is maintained unchanged, and the hair dryer can be made more manageable.

Still further, it is proposed that the channel extend along the underside of the housing, with the handle of the hair dryer being equally mounted on this underside, so that the motor cables are ducted on the most advantageous, shortest route between the inner tube and the electric operating controls in the handle.

In a further feature, the channel is provided with closable openings at the air inlet and/or air outlet end of the housing. These openings advantageously enable the channel to be put to a wide variety of uses, for example, as a cable duct.

In an independent configuration which may also be implemented without an inner tube projecting from the outer tube, it is particularly suitable to provide the housing in the area of the inlet port with an essentially smooth, closed outer surface, and to enable an additional air filter to be fitted to the outer surface of the housing.

Owing to the essentially smooth, closed outer surface of the housing in the area of the inlet port, the hair dryer may be advantageously operated either without or with an additional air filter. The smooth, closed outer surface enables the user to operate a both technically and visually complete appliance. However, to prevent contaminants from entering the hair dryer through the inlet port and to ensure safety of operation and a long service life of the appliance, an additional air filter is provided for mounting on the essentially smooth, closed outer surface of the housing.

Advantageously, this additional air filter encompasses the outer surface of the housing at least in some of its areas. The user may thus simply place this air filter onto the inlet end of the housing, similar to a lid.

Latching means for effecting a releasable connection of the air filter with the housing are provided on the essentially smooth, closed outer surface of the housing, thus enabling the user to fit the additional air filter to the housing in a simple manner, as with a clip action, for example. In a further feature, it is proposed providing a slot-shaped recess in the essentially smooth, closed outer surface of the housing. The slotted configuration of this recess provides a simple latching means for mounting the additional air filter on the housing.

In another further feature, the slot-shaped recess is disposed on the outer surface of the housing in the circumferential direction of the outer tube. As a result, this recess requires only little space on the essentially smooth, closed outer surface of the housing, advantageously enabling an additional filter to be securely fastened.

In a particularly advantageous further feature of the present invention, it is proposed manufacturing the housing of at least three housing portions and arranging all parting surfaces between the housing portions parallel to each other. The use of at least three housing portions enables the housing to be of a modular construction. This provides for a low-cost variation possibility of the individual components of the hair dryer housing.

In a further feature, the parting surfaces between the housing portions extend completely through the handle substantially parallel to the handle's main axis, and through the outer tube substantially normal to the outer tube's main axis. By reason of the conventionally used vertical arrangement of the handle relative to the outer tube, a parting surface results which extends through the full height of the housing, thus affording an advantageous mounting possibility for all parts to be mounted in the appliance.

Advantageously, the handle of the hair dryer is comprised of a handle front and rear shell and an intermediate center portion, thereby equally enabling the handle and the components therein received to be mounted with ease.

In another further feature, at least one handle shell, in particular the handle rear shell, is of a spherical configuration on its outside. This spherical configuration may involve several planes, resulting in the advantage that this handle shell provides a secure grip for its user.

In another feature of the present invention, it is proposed manufacturing the housing portions of different materials, in particular of materials of different hardness. This makes it possible to distinguish between a wide variety of model ranges of similar hair driers easily and economically.

In a further feature of the present invention, the housing is comprised of three housing portions, and the center portion is of a spherical configuration on its outside. The spherical configuration may be provided in the cross-section or, alternatively, in the longitudinal section of the center portion.

In a further feature of the hand-held hair dryer, the housing center portion is made of a material which is softer than that of the two housing outer portions. Advantageously, a more secure hold of the dryer both during and after use, when placed down on a smooth surface, is thus accomplished.

Advantageously, the handle is arranged closer to the outlet port than to the inlet port of the air-moving outer tube. In cases where additional hair styling implements such as a nozzle, a diffuser or the like are attached to the outlet port of the hair dryer, a well balanced hair dryer is thereby obtained. The handle is thus arranged at the center of gravity of the appliance which in use is prevented from tipping when in the operator's hand and allows greater ease and safety of manipulation.

As an advantageous alternative to the arrangement referred to in the foregoing, the handle may be arranged centrally between the inlet port and the outlet port of the air-moving outer tube, whereby an even weight distribution is accomplishable when the dryer is used without attachment.

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summary in the claims and their back-reference.

Figure 1:
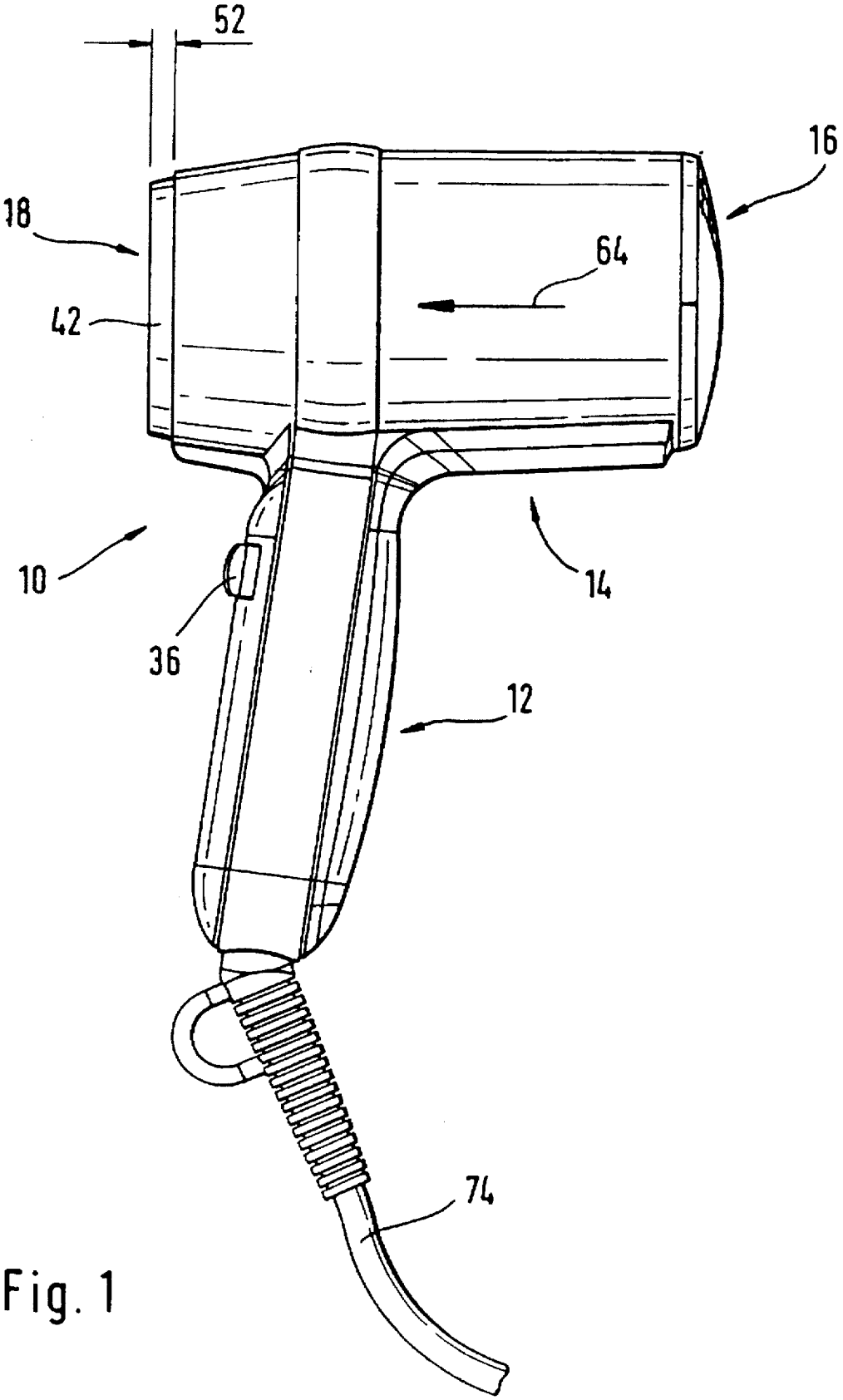
FIG. 1 is a side view of a hand-held hair dryer constructed in accordance with the present invention.

A housing 10 for a hand-held hair dryer is substantially comprised of a handle 12 and an air-moving outer tube 14 arranged approximately normal to the handle 12. To connect the hair dryer to a source of electricity, a power cord 74 is provided which enters the handle 12 at the lower end thereof. On the front side of the handle 12, operating controls 36 as, for example, an On/Off switch and a temperature selector switch, are provided. The air-moving outer tube 14 has an inlet port 16 at its rear end. Air entering at this end is passed in the direction of flow 64 through the outer tube 14 to the outlet port 18 provided at the forward end. Arranged within the outer tube 14 is an inner tube 42 which terminates flush with the outlet port 18 of the outer tube 14 or projects in the direction of flow 64 beyond the forward end of the outer tube 14 by a projecting end 52.

Figure 2:
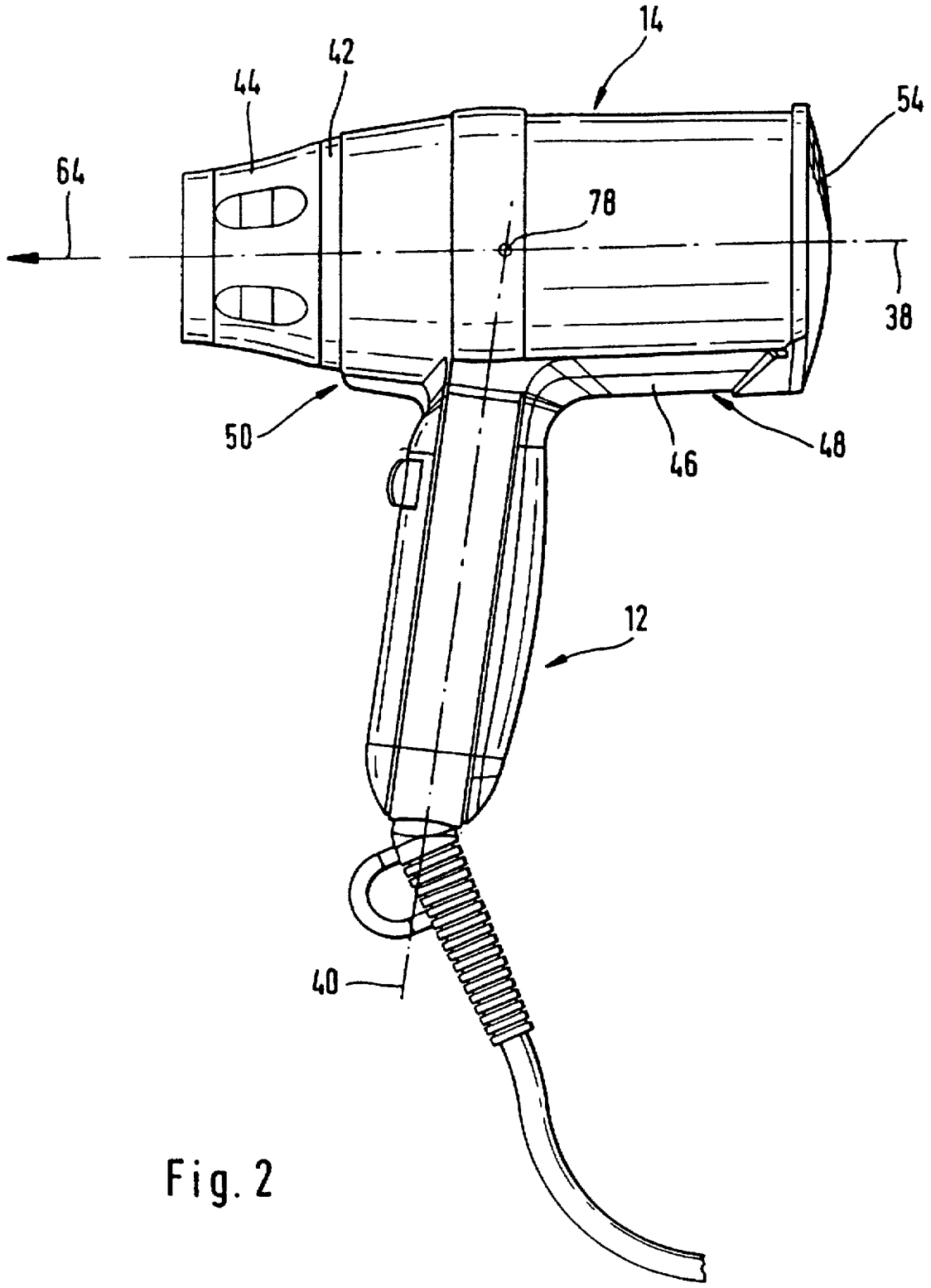
FIG. 2 is a side view of the hand-held hair dryer of FIG. 1, but fitted with a nozzle and an additional air filter.

The main axes 38 and 40 (FIG. 2) of the air-moving outer tube 14 and the handle 12, respectively, intersect at approximately right angles before the center of the outer tube 14. An additional air filter 54 is fitted to the inlet port of the outer tube 14. The air filter 54 projects over the outer tube 14 in the circumferential direction and is seated on the rear end of the outer tube in the manner of a lid. A nozzle 44 is attached to the front end of the inner tube 42 as seen in the direction of flow 64. Arranged on the housing underside 48 of the outer tube 14 is a channel 46 which is configured as a cable duct, for example. This channel 46 extends from the rear side of the handle 12 up to the rear inlet end of the outer tube 14, as well as from the front of the handle 12 up to the outlet port of the outer tube 14. An opening 50 may be provided at the forward end of the channel 46.

Figure 3:
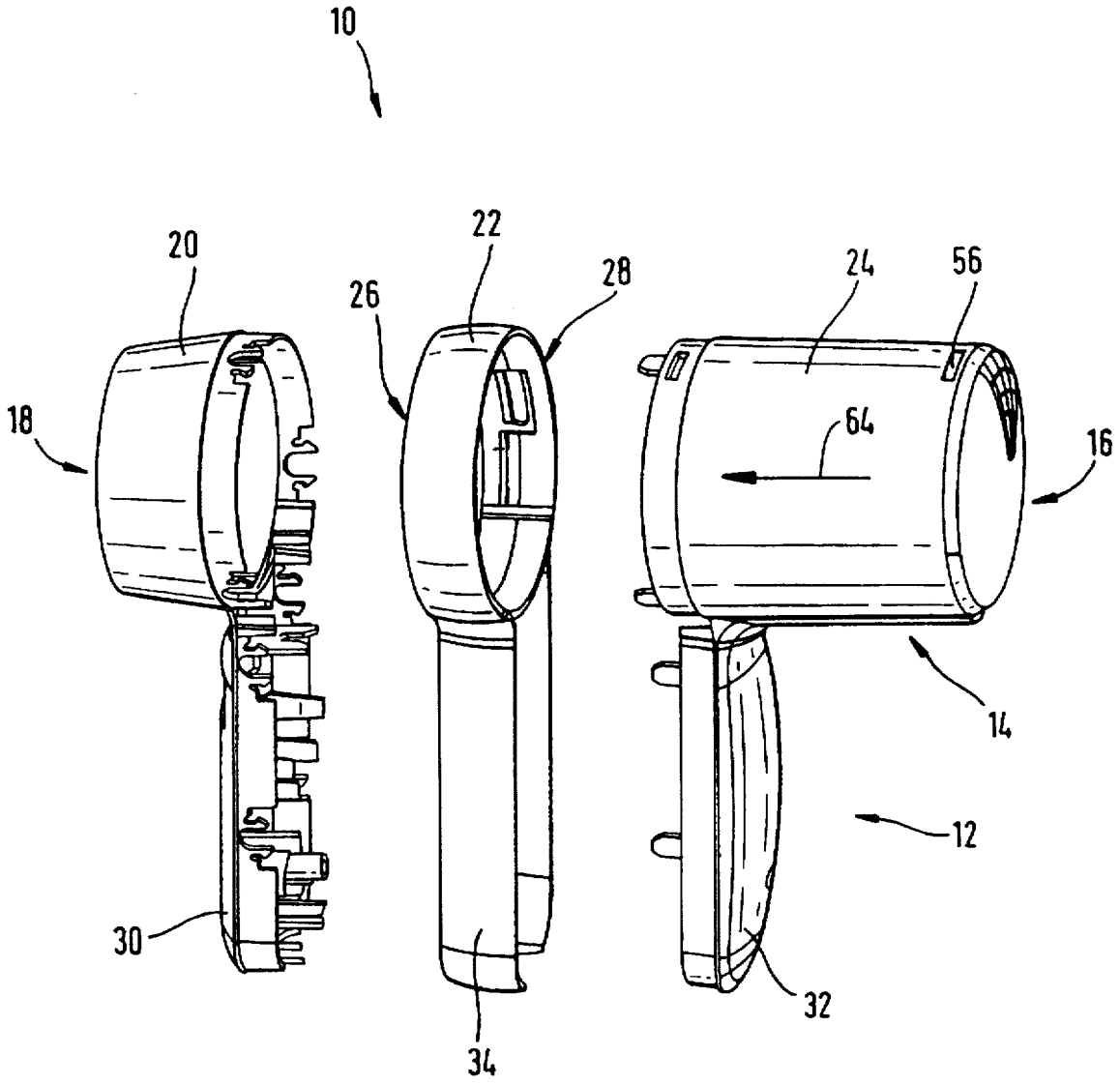
FIG. 3 is an exploded view of three housing portions for a hand-held hair dryer.

The housing 10 (FIG. 3) is fabricated from at least three housing portions; a housing front portion 20, a housing center portion 22, and a housing rear portion 24. The parting surfaces 26, 28 between the housing portions 20, 22 and 24 are arranged essentially parallel to each other, dividing the air-moving outer tube 14 perpendicularly to its direction of flow 64. The handle 12 is divided parallel to its main axis into a handle front shell 30, a handle rear shell 32, and a center portion 34. The air-moving outer tube 14 has an essentially hollow cylindrical configuration, terminating at the housing rear portion 24 with the inlet port 16. A recess 56 is provided on the smooth, closed outer surface of the housing rear portion 24. This recess 56, which is rectangular in top plan view, extends circumferentially on the housing rear portion 24 and serves as a latching means for securing an additional air filter with a snap or clip action effect.

Figure 4:
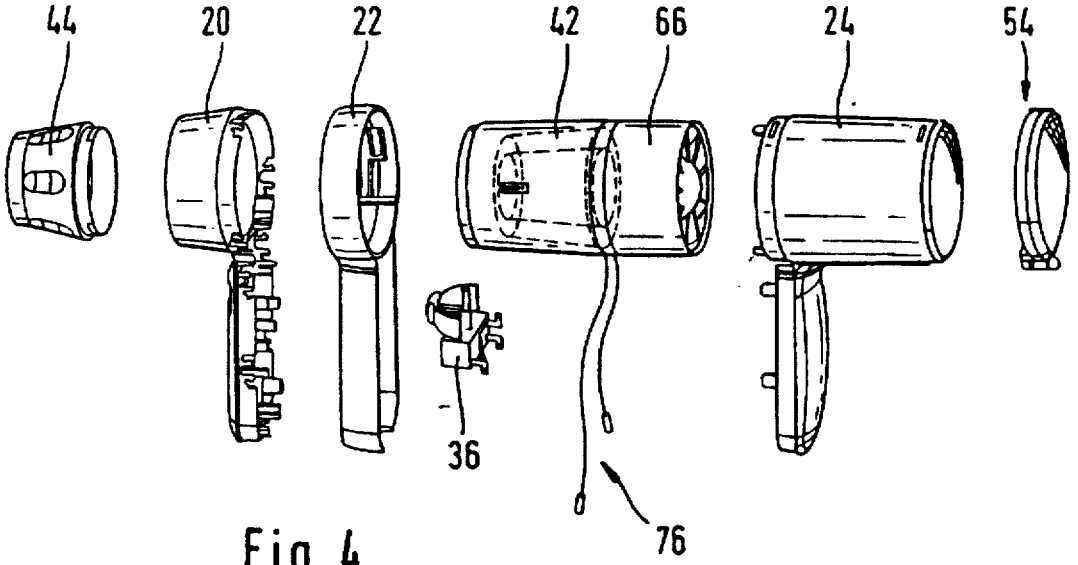
FIG. 4 is an exploded view, on a reduced scale, of a hand-held hair dryer of the present invention, showing its essential components.

The three housing portions 20, 22, 24 as well as the nozzle 44 and the additional air filter 54 are illustrated in FIG. 4 in an exploded view. Located between the housing center portion 22 and the housing rear portion 24 is the inner tube 42 with the fan casing 66. The motor cables 76 are passed out of the inner tube 42 in the proximity of the parting line between the inner tube 42 and the fan casing 66. Inner tube 42 and fan casing 66 are preassembled as a subassembly for subsequent insertion in the housing portions 20, 22 and 24. The operating controls 36, which include, for example, an On/Off switch and a temperature control, are provided in the handle portion of the housing.

Figure 5:
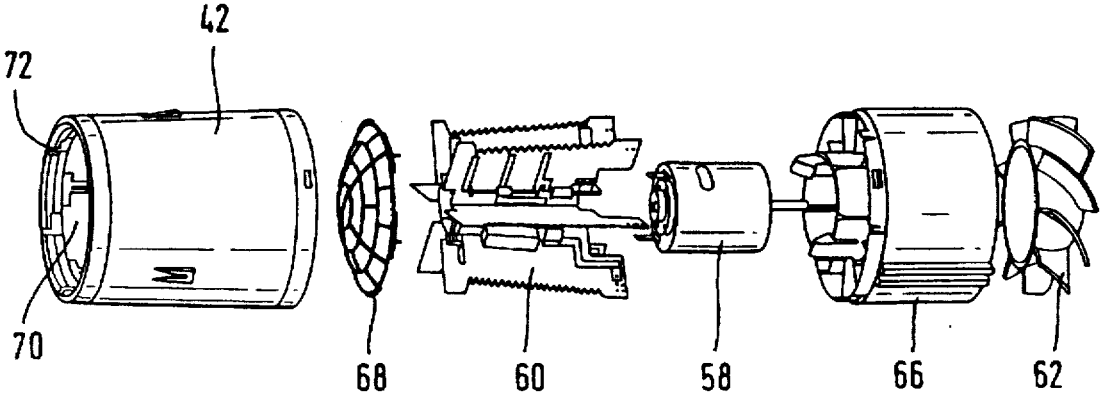
FIG. 5 is an exploded view of an inner tube and a fan casing, showing the essential components arranged therein.

The inner tube 42 and the fan casing 66 together with all the components mounted therein are shown in FIG. 5 in an enlarged representation. A protective screen 68 is inserted in the inner tube 42 and secured in the outlet port 70. Provided inside the inner tube 42 downstream of the screen 68 are latches 72 for possible attachment of a hair styling implement as, for example, a nozzle 44. Upstream of the screen 68, a heating unit 60 is disposed in the inner tube 42. This heating unit 60 is connected to a motor 58 which is in turn inserted in the fan casing 66. The fan impeller 62 is inserted in the inlet end of the fan casing 66 and connected to the drive shaft of the motor 58.

We claim:

1. A hand-held hair dryer comprising a housing having a handle and an outer tube defining an air inlet port and an air outlet port in fluid communication with one another, said outer tube further comprising a first material having a first thermal stability, a fan and a heater disposed within said housing generating and heating an air stream directed towards said air outlet port, and an inner tube received within an interior of said outer tube, said inner tube accommodating at least said heater of said fan and said heater, said inner tube further comprising a second material having a second thermal stability higher than said first thermal stability of said outer tube and wherein the inner tube extends, in a direction outward of the air outlet port, at least flush with the air outlet port and is adapted to mount a hair styling implement.

2. The hand-held hair dryer as claimed in claim 1, wherein an outlet screen is provided on the inner tube.

3. The hand-held hair dryer as claimed in claim 2, wherein the inner tube further comprises an outlet port in register with said air outlet port of said outer tube and the outlet screen is arranged in the area of the outlet port of the inner tuber.

4. The hand-held hair dryer as claimed in claim 2, wherein the outlet screen is fixed to the inner tube.

5. The hand-held hair dryer as claimed in claim 1, wherein the inner tube engages the outer tube adjacent the air outlet port.

6. The hand-held hair dryer as claimed in claim 1, wherein an outside principal dimension of the inner tube corresponds at least partially over its surface to about an inside principal dimension of the outer tube.

7. The hand-held hair dryer as claimed in claim 1, wherein the inner tube further comprises a latch for securement of a hair styling attachment to said hair dryer.

8. The hand-held hair dryer as claimed in claim 7, wherein said latch is selected from the group consisting of a bayonet-type connector and a clip lock mechanism.

9. The hand-held hair dryer as claimed in claim 1, wherein said housing further defines adjacent an exterior surface thereof a channel defining a cable duct extending in a direction of a longitudinal axis of said outer tube, said cable duct accommodating cables at least partially away from an interior space between said inner tube and said outer tube.

10. The hand-held hair dryer as claimed in claim 9, wherein the channel extends along a surface of the housing adjoining the handle.

11. The hand-held hair dryer as claimed in claim 9, wherein said housing further defines at least one closeable aperture in a region of at least one of the air inlet port and the air outlet port, said aperture communicating with the channel for admitting a cable.

12. The hand-held hair dryer as claimed in claim 1, wherein the housing further comprises at least first, second and third housing portions, said housing portions having parting surfaces extending between the housing portions parallel to each other.

13. The hand-held hair dryer as claimed in claim 12, wherein the parting surfaces extend through the handle substantially parallel to a handle longitudinal axis of the handle and through the outer tube substantially normal to the outer tube longitudinal axis.

14. The hand-held hair dryer as claimed in claim 12 wherein said first, second and third housing portions define respectively a front shell, a rear shell and a center portion.

15. The hand-held hair dryer as claimed in claim 14, wherein at least one housing portion further comprises an outside surface at least partially intersecting a spherical surface, whereby a grip region is provided for the user.

16. The hand-held hair dryer as claimed in claim 12, wherein at least one of the housing portions further comprises a material having a first hardness different from a hardness of at least one of the other housing portions.

17. The hand-held hair dryer as claimed in claim 14, wherein the center portion further comprises an outside surface at least partially intersecting a spherical surface, whereby a grip region is provided for the user.

18. The hand-held hair dryer as claimed in claim 17, wherein the housing center portion comprises a material having a hardness less than a hardness of said other housing portions.

19. The hand-held hair dryer as claimed in claim 1, wherein the handle is arranged closer to the air outlet port than to the air inlet port.

20. The hand-held hair dryer as claimed in claim 1, wherein the handle is arranged centrally between the air outlet port and the air inlet port.

21. The hand-held hair dryer as claimed in claim 1, wherein said inner tube extends beyond the air outlet port of the outer tube.

22. The hand-held hair dryer as claimed in claim 1, wherein the housing further comprises at least first, second and third housing portions, said housing portions having parting surfaces extending between the housing portions transverse to a longitudinal axis through said housing.

23. The hand-held hair dryer as claimed in claim 15, wherein said at least one housing portion is the rear shell.

24. The hand-held hair dryer as claimed in claim 20, wherein a projection of a major axis of the handle intersects a longitudinal axis of the outer tube at a location at least as proximal the air outlet port as a midpoint between the air outlet port and the air inlet port.

* * * * *

UNITED STATES PATENT AND TRADEMARK OFFICE

CERTIFICATE OF CORRECTION

PATENT NO. : 5,701,681

DATED : December 30,1997

INVENTOR(S) : Wonka et al.

It is certified that error appears in the above-identified patent and that said Letters Patent is hereby corrected as shown below:

Insert on the title page before "Foreign Application Priority Data:

-- Related U.S. Application Data:

Continuation of PCT/EP 96/01944 Filed May 9, 1996.--

Signed and Sealed this

Twenty-fourth Day of February, 1998

*Attest:*

Bruce Lehman

BRUCE LEHMAN

*Attesting Officer*

*Commissioner of Patents and Trademarks*